US010605091B2

(12) United States Patent
Garay et al.

(10) Patent No.: US 10,605,091 B2
(45) Date of Patent: Mar. 31, 2020

(54) AIRFOIL WITH CAST FEATURES AND METHOD OF MANUFACTURE

(71) Applicant: General Electric Company, Schenectady, NY (US)

(72) Inventors: Gregory Terrence Garay, West Chester, OH (US); Douglas Ray Smith, Hamilton, OH (US); Aaron Ezekiel Smith, Montgomery, OH (US); Zachary Daniel Webster, Mason, OH (US)

(73) Assignee: General Electric Company, Schenectady, NY (US)

( * ) Notice: Subject to any disclaimer, the term of this patent is extended or adjusted under 35 U.S.C. 154(b) by 1045 days.

(21) Appl. No.: 15/194,855

(22) Filed: Jun. 28, 2016

(65) Prior Publication Data

US 2017/0370229 A1 Dec. 28, 2017

(51) Int. Cl.

| | |
|---|---|
| ***F01D 5/18*** | (2006.01) |
| ***B22C 9/00*** | (2006.01) |
| ***B22C 13/08*** | (2006.01) |

(52) U.S. Cl.

CPC ..... *F01D 5/186* (2013.01); *B22C 9/00* (2013.01); *B22C 13/085* (2013.01)

(58) Field of Classification Search

None

See application file for complete search history.

(56) References Cited

U.S. PATENT DOCUMENTS

| | | | | |
|---|---|---|---|---|
| 5,291,654 | A * | 3/1994 | Judd | B22C 7/02 164/122.1 |
| 5,403,156 | A | 4/1995 | Arness et al. | |
| 5,419,681 | A | 5/1995 | Lee | |
| 5,609,779 | A | 3/1997 | Crow et al. | |
| 5,924,699 | A | 7/1999 | Airey et al. | |
| 6,362,446 | B1 | 3/2002 | Jones et al. | |
| 6,530,416 | B1 | 3/2003 | Tiemann | |
| 6,557,621 | B1 * | 5/2003 | Dierksmeier | B22C 9/103 164/368 |
| 7,275,585 | B1 * | 10/2007 | Guerche | B22C 9/04 164/45 |
| 8,057,182 | B2 | 11/2011 | Brittingham et al. | |
| 10,100,646 | B2 * | 10/2018 | Propheter-Hinckley | F01D 5/186 |
| 2008/0000610 | A1 | 1/2008 | Bunker et al. | |
| 2013/0323078 | A1 | 12/2013 | Beattie et al. | |
| 2016/0010464 | A1 | 1/2016 | Bunker et al. | |

FOREIGN PATENT DOCUMENTS

| | | |
|---|---|---|
| EP | 2 383 436 A2 | 11/2011 |
| EP | 3296037 | 3/2018 |

OTHER PUBLICATIONS

International Search Report and Written Opinion issued in connection with corresponding PCT Application No. PCT/US2017/34599 dated Jul. 24, 2017.

* cited by examiner

*Primary Examiner* — Woody A Lee, Jr.

(74) *Attorney, Agent, or Firm* — McGarry Bair PC

(57) ABSTRACT

An apparatus and method for forming a film hole in an outer wall of an airfoil. The film hole includes a blind opening adjacent the interior of the airfoil and a hole adjacent the exterior of the airfoil. The blind opening fluidly couples to the hole to form the film hole for providing a volume of fluid as a surface cooling film along the exterior of the outer wall.

19 Claims, 10 Drawing Sheets

AIRFOIL WITH CAST FEATURES AND METHOD OF MANUFACTURE

BACKGROUND OF THE INVENTION

Turbine engines, and particularly gas or combustion turbine engines, are rotary engines that extract energy from a flow of combusted gases passing through the engine onto a multitude of rotating turbine blades.

Turbine engines for aircraft, particularly gas turbine engines, for example, are designed to operate at high temperatures to maximize engine efficiency, so cooling of certain engine components, such as the high pressure turbine, can be beneficial. Typically, cooling is accomplished by ducting cooler air from the high and/or low pressure compressors to the engine components that require cooling. Temperatures in the high pressure turbine are around 1000° C. to 2000° C. and the cooling air from the compressor is around 500° C. to 700° C. While the compressor air is a high temperature, it is cooler relative to the turbine air, and can be used to cool the turbine.

Contemporary turbine airfoils generally include one or more interior cooling passages for routing the cooling air through the airfoil to cool different portions, such as the walls of the airfoil. Often, film holes are used to provide the cooling air from the interior cooling passages to form a surface cooling film to separate the hot air from the airfoil surface.

BRIEF DESCRIPTION OF THE INVENTION

In one aspect, embodiments of the invention relate to a method of manufacturing an airfoil with an outer wall having a hollow interior for a turbine engine including: (1) forming a mold core with at least one nub; (2) enclosing the mold core within a mold shell to define a cavity between the mold core and the mold shell, with the at least one nub extending into the cavity; (3) forming a casting having the outer wall with a blind opening formed by the at least one nub by pouring liquid into the cavity where the liquid flows around the at least one nub, letting the liquid harden, and removing the mold shell and mold core; and (4) forming at least one hole in the outer wall from an exterior of the outer wall, with the at least one hole intersecting the at least one blind opening.

In another aspect, embodiments of the invention relate to an airfoil for a turbine engine including an outer wall having an outer surface and an inner surface bounding a hollow interior. The outer wall defines a pressure side and a suction side extending axially between a leading edge and a trailing edge, and extending radially between a root and a tip. The airfoil further includes at least one blind opening cast in the inner surface and terminating within the wall, and at least one machined opening extending through the outer surface and intersecting the blind opening.

DESCRIPTION OF EMBODIMENTS OF THE INVENTION

Figure 1:
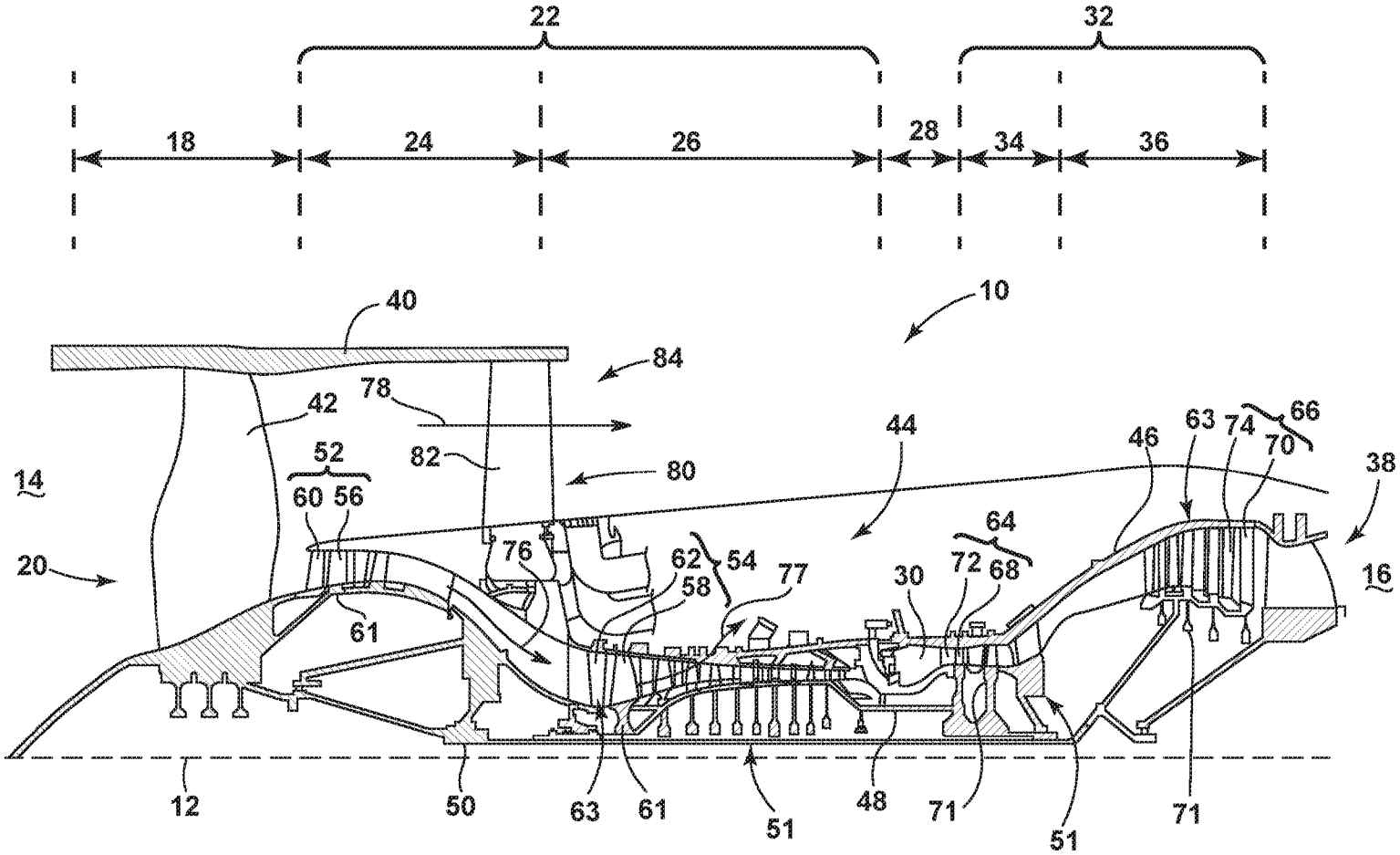
FIG. 1 is a schematic cross-sectional diagram of a gas turbine engine for an aircraft.

The described embodiments of the present invention are directed to forming film holes in the outer wall of an airfoil for a turbine engine. For purposes of illustration, the present invention will be described with respect to the turbine for an aircraft gas turbine engine. It will be understood, however, that the invention is not so limited and may have general applicability within an engine, including compressors, as well as in non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component.

Additionally, as used herein, the terms "radial" or "radially" refer to a dimension extending between a center longitudinal axis of the engine and an outer engine circumference.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present invention, and do not create limitations, particularly as to the position, orientation, or use of the invention. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a gas turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the centerline 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized airflow 76 to the HP compressor 26, which further pressurizes the air. The pressurized airflow 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be draw from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

Figure 2:
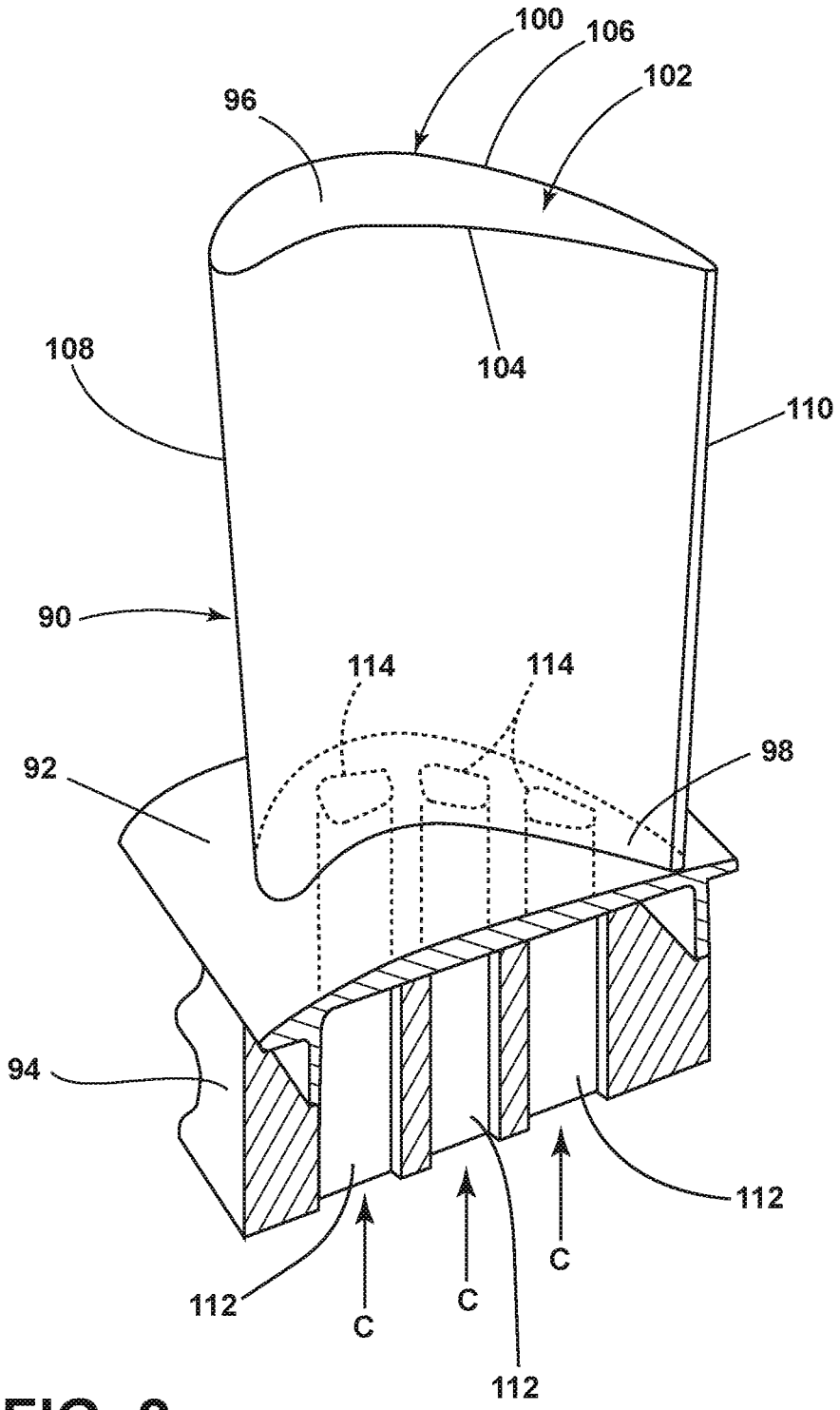
FIG. 2 is a perspective view of an airfoil for the gas turbine engine of FIG. 1.

FIG. 2 is a perspective view of an airfoil 90, a platform 92, and a dovetail 94, which can be a rotating blade 68, as shown in FIG. 1. Alternatively, it is contemplated that the airfoil 90 can be a stationary vane. The airfoil 90 includes a tip 96 and a root 98, defining a span-wise direction therebetween. Additionally, the airfoil 90 includes an outer wall 100. A hollow interior 102 is defined by the outer wall 100. A pressure side 104 and a suction side 106 are defined by the airfoil shape of the outer wall 100. The airfoil 90 further includes a leading edge 108 and a trailing edge 110, defining a chord-wise direction.

The airfoil 90 mounts to the platform 92 at the root 98. The platform 92 as shown is only a section, and can be an annular band for mounting a plurality of airfoils 90. The airfoil 90 can fasten to the platform 92, such as welding or mechanical fastening, or can be integral with the platform 92.

The dovetail 94 couples to the platform 92 opposite of the airfoil 90, and can be configured to mount to the disk 71, or rotor 51 of the engine 10 (FIG. 1), for example. The dovetail 94 can include one or more inlet passages 112, having an outlet 114 disposed at the root 98. It should be appreciated that the dovetail 94 is shown in cross-section, such that the inlet passages 112 are housed within the body of the dovetail 94. The inlet passages 112 can provide a cooling fluid flow C to the interior 102 of the airfoil 90 for cooling of the airfoil 90 in one non-limiting example. It should be understood that while the description herein is related to an airfoil, it can have equal applicability in other engine components requiring cooling such as film cooling. Such engine components can include but are not limited to, a shroud, a blade, a vane, or a combustion liner.

Figure 3:
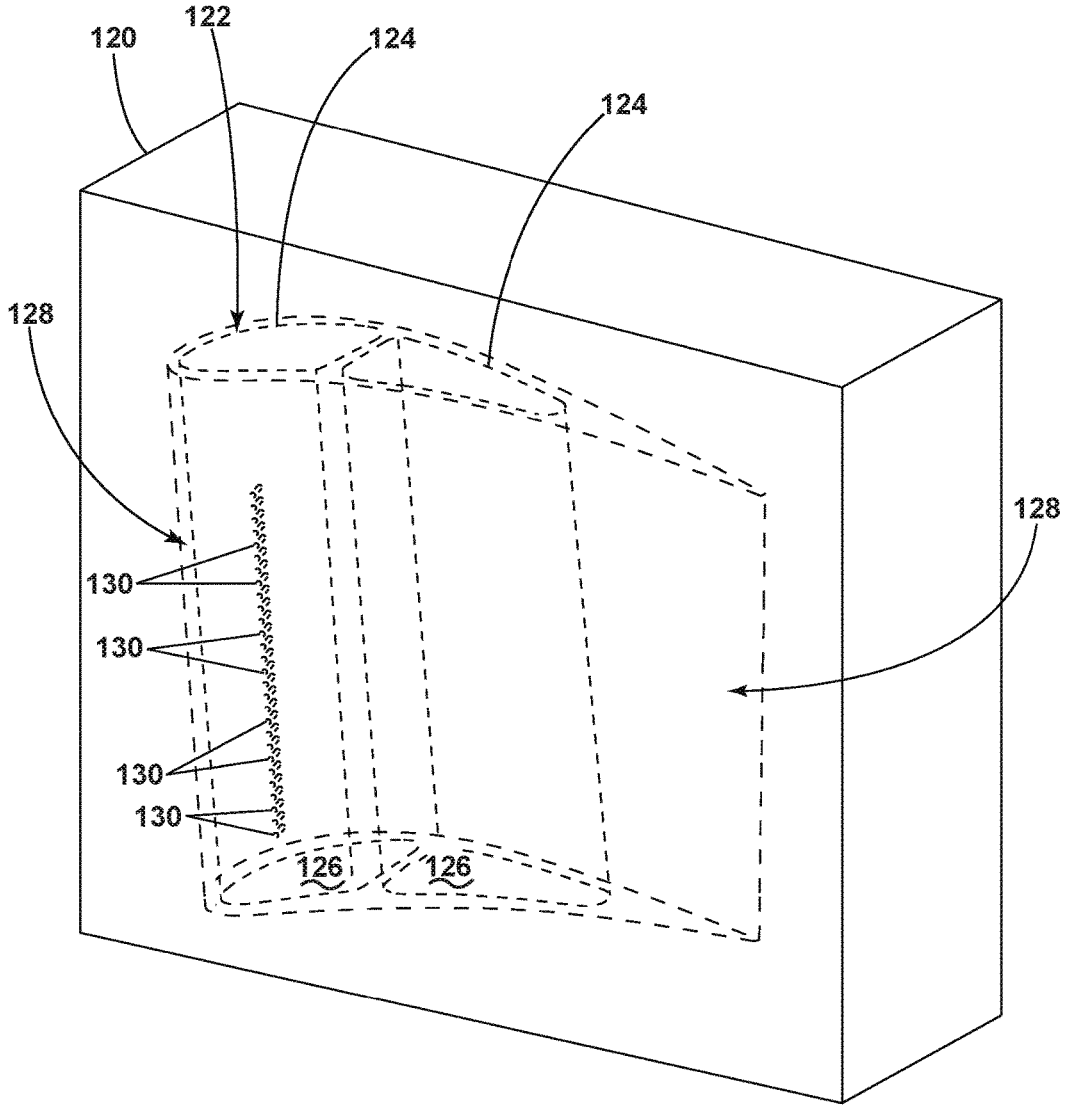
FIG. 3 is a perspective view of the airfoil of FIG. 2 formed around a mold core and surrounded by a mold shell defining a hollow forming the airfoil.

FIG. 3 illustrates the airfoil 90 defined by a mold shell 120, having a mold core 122 disposed within the interior 102. The mold core 122 can include two discrete cores 124 to define different chambers 126 within the interior 102. The mold core 122 is positioned within the mold shell 120 to define a cavity 128 between the mold shell 120 and the mold core 122. The cavity 128 can include a particularly defined geometry to particularly form the airfoil 90.

At least one nub 130 can be formed on the mold core 122. The nubs 130 can be cylindrical elements, extending from the side of the mold core 122 into the cavity 128. While it is illustrated that the nubs 130 extend toward the pressure side 104, it should be understood that the nubs 130 can extend from any position on the mold core 122. The cylindrical shape of the nubs 130 is exemplary, and it should be appreciated that the nubs can be any shape, such as rectilinear, circular, bar-shaped, or arcuate in non-limiting examples.

The at least one nub 130 can be a plurality of discrete nubs 130 extending into the cavity 128. In another example, the nub 130 can be a single elongated member extending longitudinally along the cavity 128. In yet another example, the nub 130 can be a plurality of organized nubs 130, defining groups, patterns, or arrangements. It should be appreciated that the nubs 130 can be disposed on the mold core 122 in any pattern or combination, with constant or varying spacing/density per unit area.

The mold core 122 is particularly positioned within the mold shell 120, such that the mold shell 120 encases the mold core 122 to carefully define the geometry of the cavity 128 for forming the airfoil 90. In forming the airfoil 90, a liquid is poured into the cavity 128. During pouring of the liquid into the cavity 128, the liquid will flow around the at least one nub 130. After pouring the liquid into the cavity 128, the liquid can set, until it hardens, forming the airfoil 90 and having the airfoil 90 including geometries as defined by the nubs 130.

Figure 4:
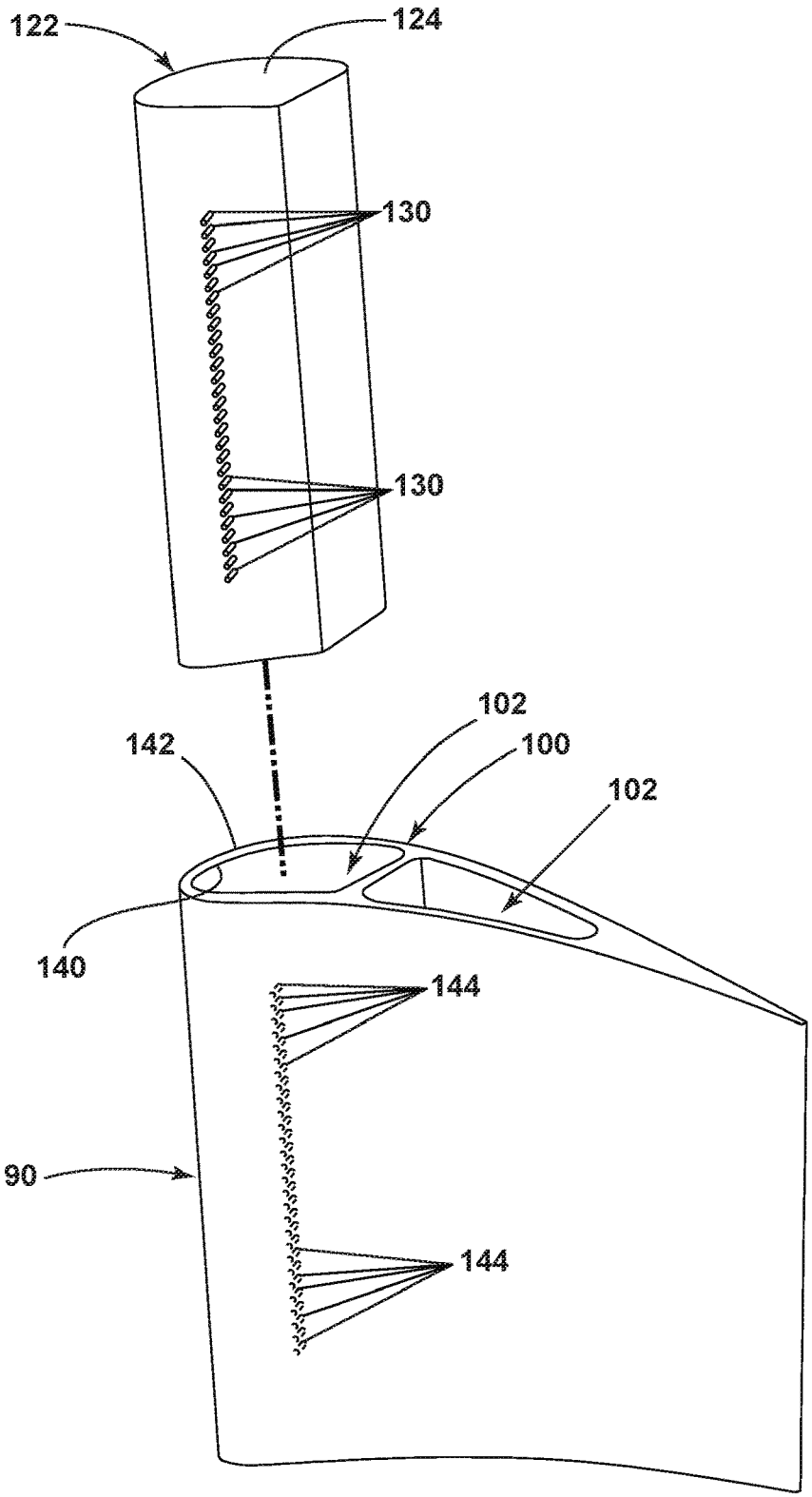
FIG. 4 is an exploded view, illustrating the mold core of FIG. 3 exploded from the airfoil.

After allowing the liquid to solidify the mold shell 120 can be removed. Referring now to FIG. 4, after removal of the mold shell 120, the mold core 122 can be removed from the interior 102, leaving the airfoil 90. The outer wall 100 is shaped by the cavity 128, and can include an inner surface 140 and an outer surface 142. The inner surface 140 is formed by the mold core 122 and the outer surface 142 was formed by the mold shell 120. Removal of the mold core 122 can leave at least one blind opening 144 complementary to the nubs 130 on the mold core 122. Thus, the nubs 130 form the blind openings 144 in the inner surface 140 during casting of the airfoil 90.

Figure 5:
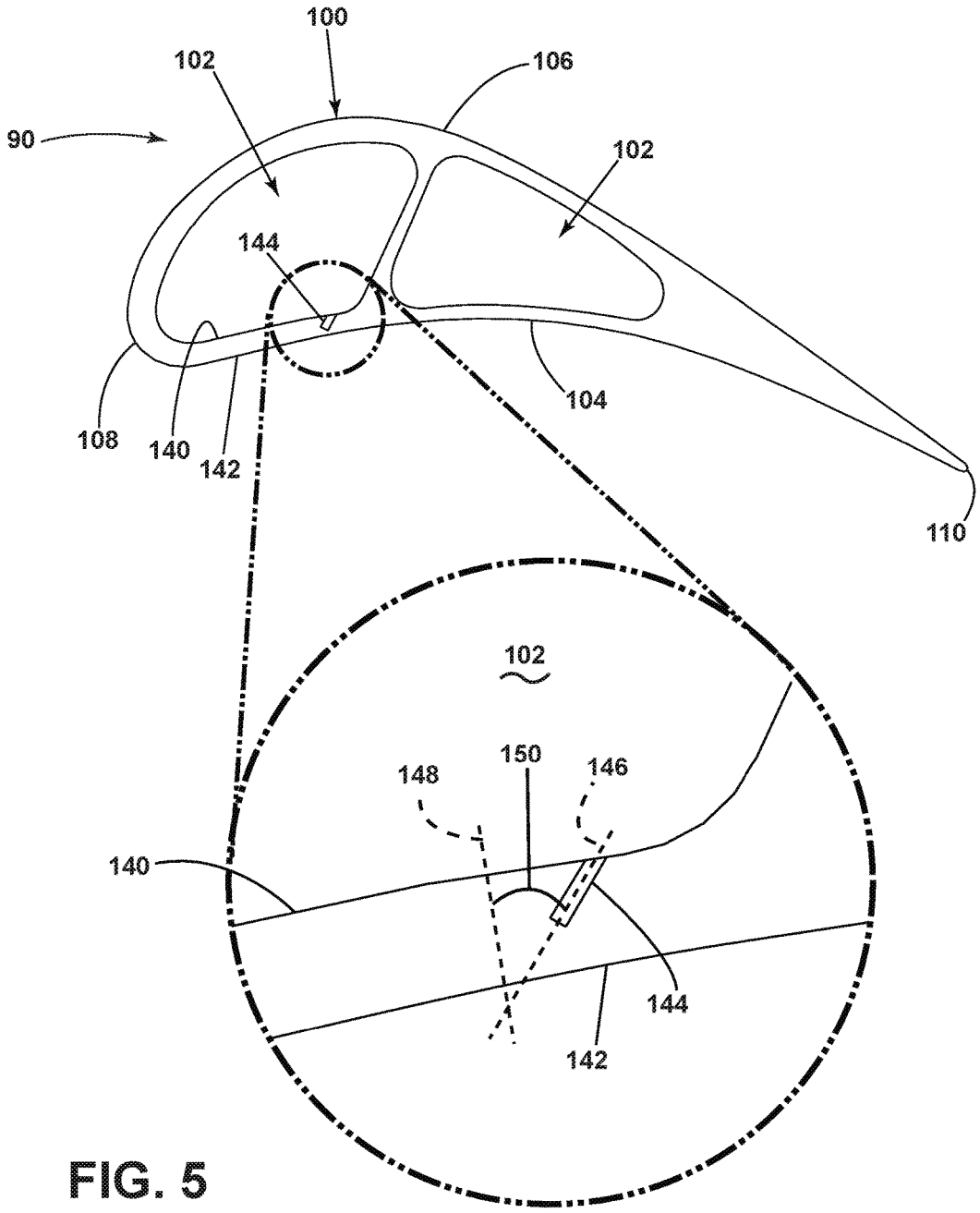
FIG. 5 is a cross-sectional view of the airfoil of FIG. 2 illustrating a blind opening formed in a wall of the airfoil.

Referring now to FIG. 5, one or more blind opening 144 is formed in the outer wall 100. The blind opening 144 can be linear, defining a longitudinal opening axis 146 through the blind opening 144. An orthogonal axis 148 disposed orthogonal to the outer wall 100 can define a blind opening angle 150 for the blind opening 144. The blind openings 144 are formed by the nubs 130 during the casting process, and remain after removal of the mold core 122. As such, the geometries, organizations, and orientations of the blind openings 144 are resultant of the geometries, organizations, and orientations of the nubs 130 on the mold core 122.

Figure 6A:
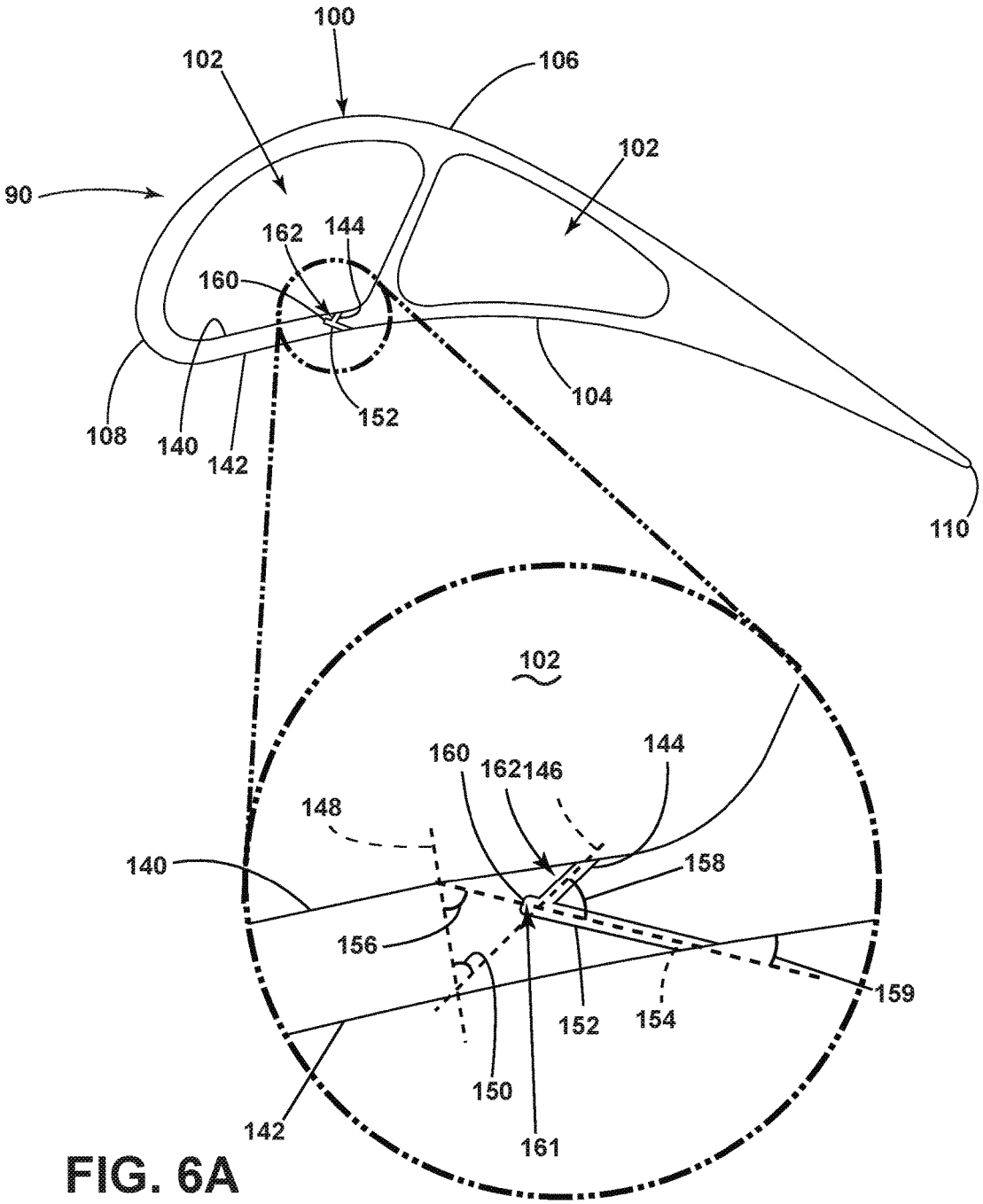
FIG. 6A is a cross-sectional view of the airfoil of FIG. 5 including a hole formed in the wall intersecting the blind opening disposed at a shallow angle.
Figure 6B:
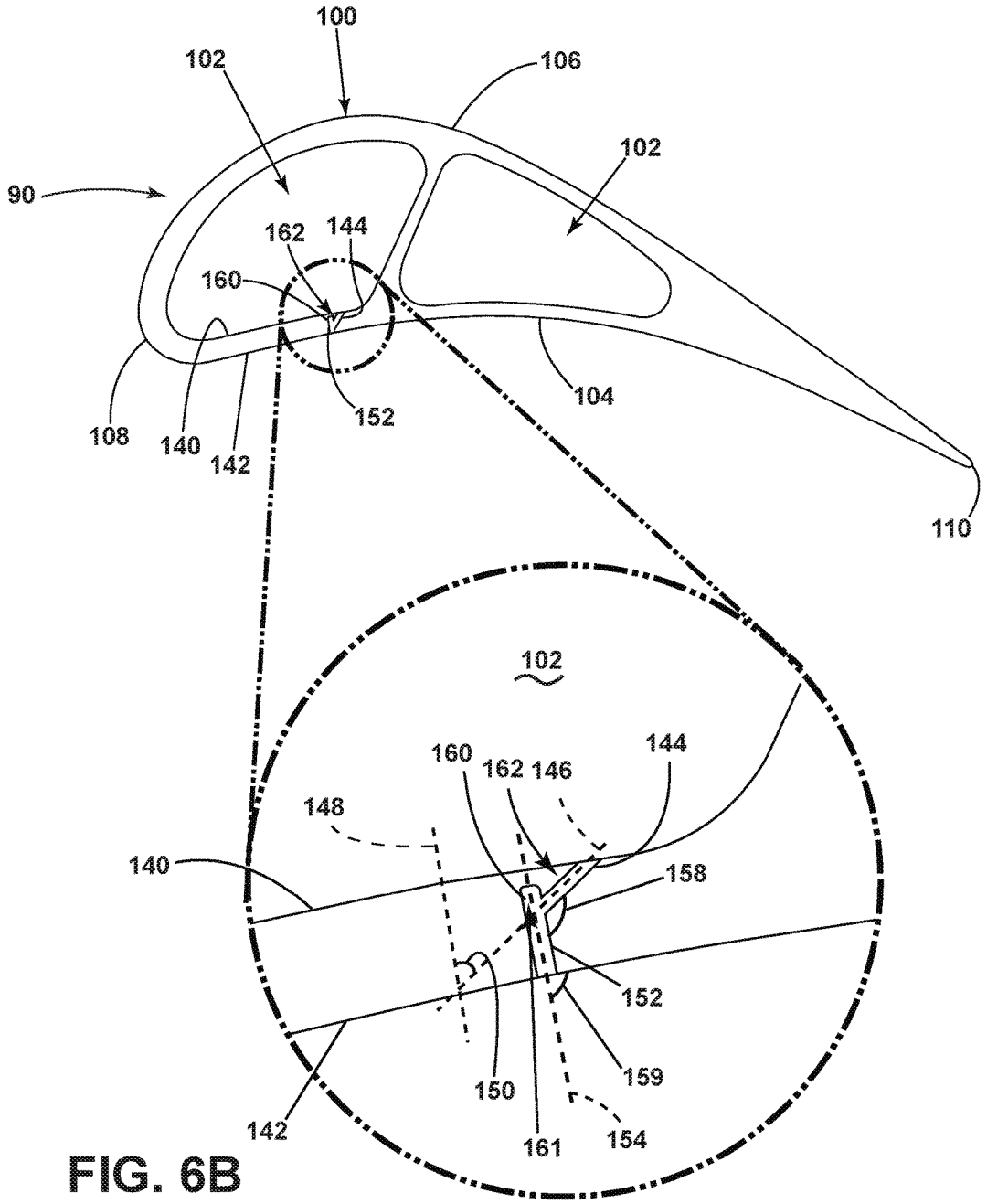
FIG. 6B is a cross-sectional view of the airfoil of FIG. 5 including a hole formed in the wall intersecting the blind opening disposed at a normal angle.

Referring now to FIGS. 6A and 6B, a machined opening illustrated as a hole 152 can be formed in the outer surface 142 of the outer wall 100. The hole 152 can intersect the blind opening 144. The hole 152 can define a hole axis 154 along the longitudinal length of the hole 152. The hole 152 can further define a hole angle 156 as the angle between the hole axis 154 and the orthogonal axis 148. The holes can be the machined opening and can be formed by machining such as by drilling or electric discharge machining (EDM), such as small-hole drilling EDM and sinker EDM, or laser ablation in non-limiting examples.

A first angle 158 can be defined between the opening axis 146 and the hole axis 154. The first angle 158 can be acute, normal, or obtuse, up to one-hundred and eighty degrees. A second angle 159 can be defined between the outer surface and the hole axis 154. The second angle 159, in a first example shown in FIG. 6A, can be between 5 degrees and 40 degrees, providing a film of cooling air along the outer surface 142 near to parallel to the outer surface 142. The second angle 159, in another example shown in FIG. 6B, can be between about 70 degrees and 110 degrees, and can be about 90 degrees in one example, having slight variation therefrom.

A fluid deflector or joint 160 is defined at the junction between the blind opening 144 and the hole 152. The hole 152 can include the joint 160, extending beyond the blind opening 144 toward the inner wall 140 to define a joint cavity 161. The joint 160 has an arcuate profile and can have a semi-circular shape in one-non-limiting example. In other examples, the shape can be a domed-shape, hemispherical shape, or an ellipsoidal shape.

A film hole 162 can be defined by the combined blind opening 144, the hole 152, and the joint 160. The film hole 162 can fluidly couple the interior 102 to the exterior of the airfoil 90. The orientation and geometry of the blind opening 144 and the hole 152 can define the film hole 162, being further defined by the first angle 158 and the second angle 159. The joint 160 can provide for internal shaping of the film hole 162 and can provide directionality for a flow of fluid passing through the film hole 162, as well as metering of the flow. The joint cavity 161 defined by the joint 160 can further be used to provide metering of the airflow.

Figure 7:
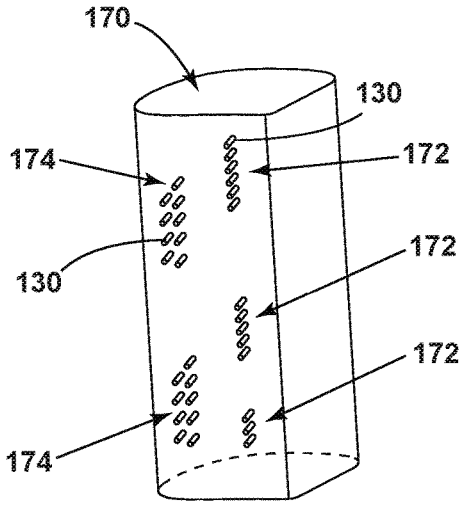
FIG. 7 is a perspective view of an alternative mold core having groups of nubs.

Referring now to FIG. 7, an alternative mold core 170 is illustrated, including a plurality of nubs 130 organized into linear sets 172 and patterned groups 174. As such, blind openings are formed in the outer wall 100 based upon the nubs 130 on the mold core 170 during the casting process. The patterned group 174 as shown is a staggered group of nubs 130. In alternative examples, the patterned group 174 can be any arrangement, such as sets, rows, columns, groups, or any combination thereof such that a pattern is formed. In yet another example, the nubs 130 can be disposed in a discrete organizations, such as single or discrete nubs 130. Any organization of the nubs 130 as described herein can be used to make complementary blind openings. Such organizations can be based upon temperature needs, pressures around the airfoil, or structural requirements of the airfoil.

Figure 8:
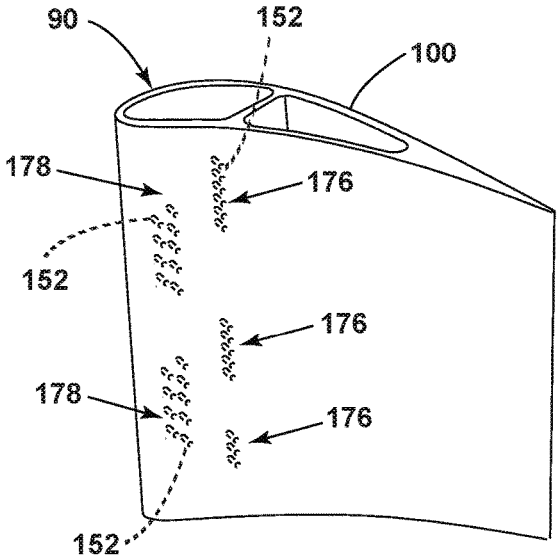
FIG. 8 is a perspective view illustrating the airfoil formed by the mold core of FIG. 7.

Turning now to FIG. 8, the holes 152 disposed in the outer wall 100 can be formed respective of the blind openings created by the nubs 130 of the mold core 170 of FIG. 7. Thus, it should be appreciated that blind openings can be formed in the outer wall 100 as desired based upon the particular mold core 122 having a plurality of nubs 130. The holes 152 as shown can be formed in groups, such as linear sets 176 and patterned groups 178 complementary to the nubs 130 of FIG. 7. Alternatively, it is contemplated that the holes 152 can be enlarged or elongated openings, fluidly coupling multiple blind openings to the exterior of the airfoil 90.

Figure 9:
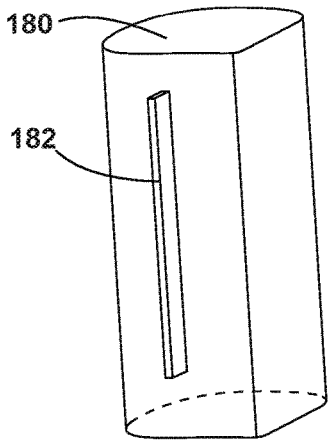
FIG. 9 is a perspective view of another alternative mold core having an elongated nub.

Referring now to FIG. 9, a mold core 180 can include a nub 182 formed as an elongated element. The elongated bar-shaped nub 182 can define a blind opening in the outer wall having the similar elongated bar shape as the nub 182. The elongated nub 182 can have any shape, such as linear, arcuate, unique, or any combination thereof in non-limiting examples. It should be understood that the elongated nub 182 will create a similar-shaped blind opening during casting.

Figure 10:
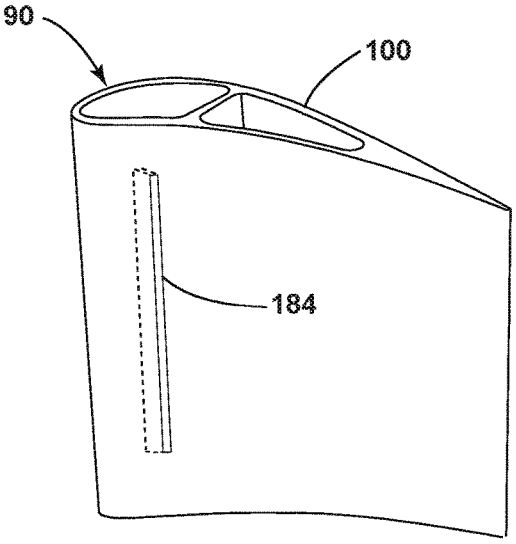
FIG. 10 is a perspective view illustrating the airfoil formed by the mold core of FIG. 9.

Turning now to FIG. 10, a complementary bar-shaped hole forming a slot 184 can be formed in the outer wall 100 to fluidly couple to a blind opening created by the elongated nub 182. The slot 184, for example, can be a slot disposed in the outer wall 100 of the airfoil 90. The slot 184 can be elongated to fluidly couple along the entire elongated length of the complementary blind opening, or can be discrete holes. Such discrete holes can be used to meter the flow provided from the interior of the airfoil 90.

It should be understood that the nubs, blind openings, and holes as illustrated in FIGS. 3-10 as shown are by way of example only and should be construed as non-limiting. Any organization of nubs and complementary blind openings can be used in combination with any hole or organization of holes. In one example, a plurality of linearly arranged nubs can define a linear arrangement of blind openings in the inner surface of the outer wall (see FIG. 4). An elongated hole such as the hole of FIG. 10 can be used to fluidly couple all of the blind openings to the exterior of the airfoil through the outer wall.

In another example, the bar-shaped nub of FIG. 9 can be used to create a bar-shaped blind opening in the outer wall 100. A plurality of discrete holes can be used to fluidly couple the bar shaped blind opening to the exterior of the airfoil 90. Thus, it should be appreciated that any such organization of one or more nubs, being discrete, linear, patterned, elongated, or otherwise can be used to shape complementary blind openings, which can fluidly couple to any organization of holes, being discrete, linear, patterned, elongated, or otherwise, in non-limiting examples.

Figure 11:
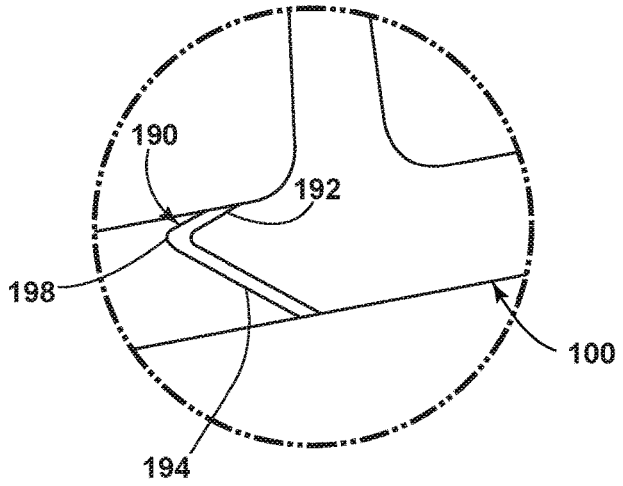
FIGS. 11-13 illustrate alternative holes formed in the outer wall and intersecting the blind openings formed in the wall.
Figure 12:
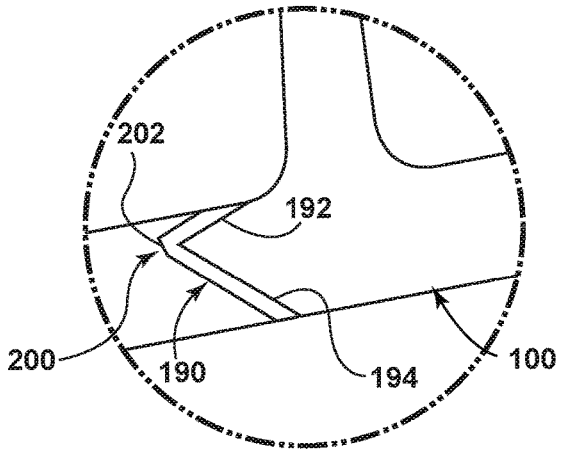
Figure 13:
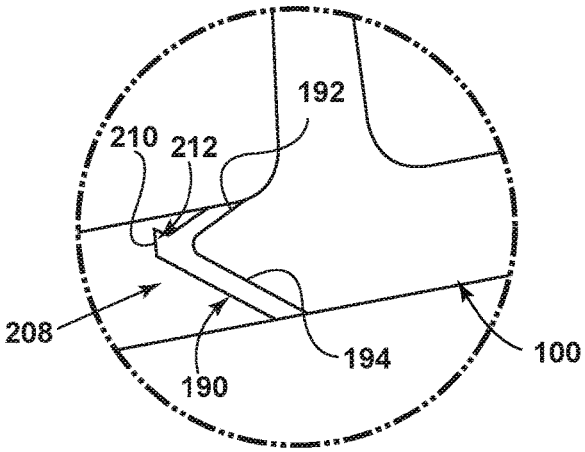

Referring now to FIG. 11, a film hole 190 is defined by a blind opening 192 and a hole 194, which can comprise any blind opening or hole as described herein. A fluid deflector or joint 198 is defined at the junction between the blind opening 192 and the hole 194. The joint 198 can be rounded to turn a flow of fluid passing through the blind opening 192 into the hole 194 along the curved surface of the joint 198. Referring now to FIG. 12, another exemplary fluid deflector or joint 200 can be rectilinear, including a rear wall 202 at the junction between the blind opening 192 and a hole 194. The rear wall 202 can be angled to act as a fluid deflector to provide improved directionality of the flow passing from the blind opening 192 to the hole 194. FIG. 13 illustrates yet another exemplary fluid deflector or joint 208, including an angled back wall 210, defining a rear cavity 212 disposed behind the blind opening 192. The angled back wall 210 can act as a fluid deflector, similar to the rear wall 202 of FIG. 12, to provide improved directionality of a flow passing from the blind opening 192 to the hole 194.

It should be understood that the junction between the blind openings and the holes can be shaped to effect a flow of fluid passing through the film hole. Such an effect can include, in non-limiting examples, improved turning of the fluid flow, metering of the fluid flow, diffusing of the fluid flow, or accelerating or decelerating the fluid flow.

Figure 14:
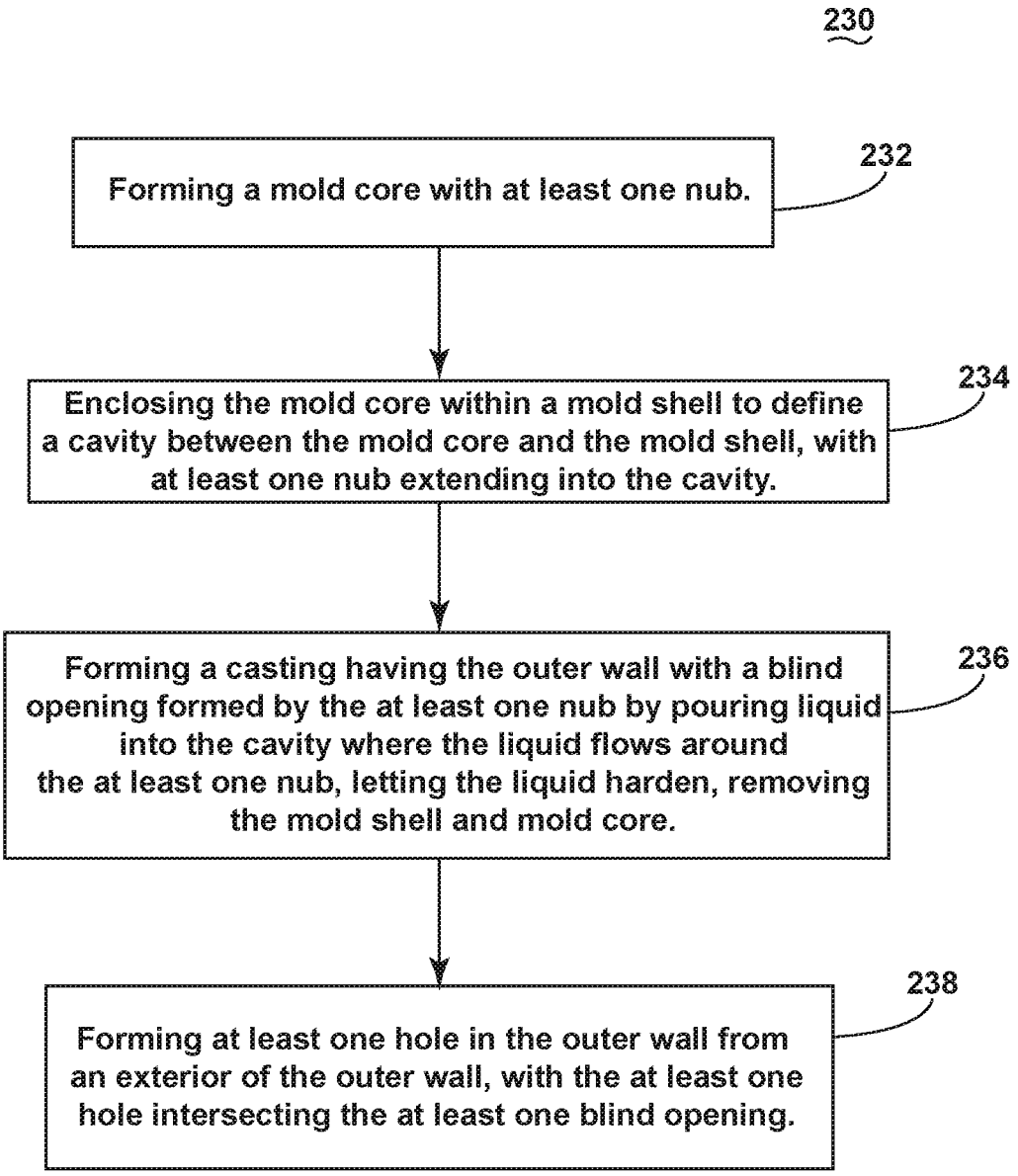
FIG. 14 is a flow chart illustrating a method of manufacturing the airfoil with an outer wall having the blind openings and the holes.

Referring now to FIG. 14 a method 230 of manufacturing an airfoil, such as the airfoil 90 of FIGS. 3-13, can include, at 232, forming a mold core with at least one nub. The mold core can be the mold core 122 of FIGS. 3-4 for example, having the nubs 130 organized in any orientation. Such organizations of nubs 130 can include, rows, columns, patterns, groups or otherwise in non-limiting examples. Additionally, groups of nub 130 can be arranged or organized in different densities, in order to meter a flow of cooling fluid locally along the airfoil 90.

At 234, the method 230 includes enclosing the mold core 122 within a mold shell, such as the mold shell 120 of FIG. 3, to define a cavity between the mold core and the mold shell, with the at least one nub extending into the cavity. The cavity can be the cavity 128 as described in FIG. 3 used to form the particular airfoil 90. The at least one nub 130, or plurality of nubs 130 can be arranged in any manner described herein and shaped in any manner as described herein, such as a cylinder or bar. The at least one nub extends from the mold core 122 into the cavity 128.

At 236, the method 230 includes forming a casting having an outer wall, as the outer wall 100 of the airfoil 90, with a blind opening formed by the at least one nub 130. The blind opening can be any blind opening 144 as described herein. The casting can be formed by pouring a fluid, such as a liquid, into the cavity 128 where the liquid flows around the at least one nub 130, letting the liquid harden, and removing the mold shell 120 and mold core 122. Thus, the formed casting can comprise the airfoil 90.

At 238, the method 230 includes forming at least one hole in the outer wall 100 from an exterior of the outer wall 100, with the at least one hole intersecting the at least one blind opening 144. The at least one hole can be the hole 152 as described in FIG. 6, for example. The hole 152 can be a blind hole, in one example. The hole 152 can define the first angle 158 and the second angle 159 of FIGS. 6A and 6B. In one example, the second angle 159 can be between about 40 degrees and 5 degrees, and in yet another example, the second angle 159 can be about 90 degrees. Forming the at least one hole 152 can include forming a slot, or an elongated slot. Such a hole 152 can fluidly couple to one or more blind openings 144. Where forming the at least one nub 130 includes forming a plurality of nubs, forming a plurality of corresponding blind openings, at least some of the blind openings can fluidly couple to the slot. In another example, the nub 130 can be an elongated bar, to form an elongated blind opening 144, which can fluidly couple to the hole 152 along a span-wise length of the outer wall 100.

The nub 130 can be shaped such that a sloped surface is formed at the terminal end of the blind opening 144 to form a fluid deflector in the blind opening 144. The fluid deflector, for example, can be the rear wall 202 of FIG. 12, or can be the back wall 210 of FIG. 13. The blind opening 144 can intersect the hole 152 opposite of the fluid deflector. Forming the at least one hole 152 can include forming the hole with a drill or a sinker EDM in non-limiting examples.

It should be appreciated that the airfoil, and a method of manufacturing the airfoil, as described herein provides for improved surface film cooling along the external surface of the airfoil. The improved film cooling is achieved by enabling the shallow angle between the airfoil exterior surface and the hole to be minimized. Such a minimized, shallow film hole, is not achievable by conventional production methods. Thus, the method as described herein provides for such an improved airfoil having improved surface film cooling. Additionally, the method as described herein provides for improved casting yield while enabling the shallow angle for delivering the cooling film to the exterior of the airfoil. Additionally, the blind openings can be particularly cast, in order to meter a flow entering the film hole. As the flow passes from the blind opening, the flow can be provided in a dynamic, or continuous manner, exhausting from the hole. As such, the film hole can be tailored to provide optimal surface film cooling, which can improve cooling efficiency and specific fuel consumption.

It should be appreciated that application of the disclosed design is not limited to turbine engines with fan and booster sections, but is applicable to turbojets and turbo engines as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of manufacturing an airfoil with an outer wall having a hollow interior for a turbine engine comprising:

forming an elongate mold core with a plurality of nubs projecting from the mold core and arranged in sets, with at least some of the sets having a non-uniform spacing therebetween;

enclosing the mold core within a mold shell to define a cavity between the mold core and the mold shell, with the plurality of nubs extending into the cavity;

forming a casting having the outer wall with a plurality of blind openings formed by the corresponding plurality of nubs by pouring liquid into the cavity where the liquid flows around the plurality of nubs, letting the liquid harden, and removing the mold shell and the mold core; and forming a plurality of holes in the outer wall from an exterior of the outer wall, with each hole in the plurality of holes intersecting a corresponding blind opening in the plurality of blind openings.

2. The method of claim 1 wherein the plurality of holes forms an angle with the outer wall between 5 degrees and 40 degrees.

3. The method of claim 1 wherein the plurality of holes forms an angle with the outer wall between 70 degrees and 110 degrees.

4. The method of claim 3 wherein the angle is 90 degrees.

5. The method of claim 1 wherein at least some of the plurality of nubs are arranged in rows or columns.

6. The method of claim 1 wherein the plurality of nubs comprises at least one of a cylinder or a bar.

7. The method of claim 1 wherein at least one nub in the plurality of nubs has a shape that forms a sloped surface in a terminal end of the blind opening to form a fluid deflector in the blind opening.

8. The method of claim 7 wherein the plurality of holes intersects the blind opening opposite the fluid deflector.

9. The method of claim 8 wherein the shape is a dome that defines the sloped surface.

10. The method of claim 1 wherein forming the at least one hole comprises forming a slot.

11. The method of claim 10 wherein at least some of the blind openings are intersected by the slot.

12. The method of claim 1 wherein forming the plurality of holes comprises at least forming the hole with a drill, a sinker EDM, or a laser.

13. The method of claim 1 wherein the plurality of holes is a blind hole.

14. The method of claim 1 wherein the plurality of nubs is organized into multiple linear sets.

15. The method of claim 14 wherein the multiple linear sets comprise a first linear set spaced from a second linear set to form a gap between the first and second linear sets.

16. The method of claim 1 wherein the plurality of nubs is organized into at least one patterned group.

17. The method of claim 16 wherein the at least one patterned group comprises a staggered group of nubs having offset rows and columns.

18. The method of claim 1 wherein the non-uniform spacing further comprises a first spacing proximate a first end of the mold core and a second spacing proximate a second end of the mold core.

19. The method of claim 18 wherein the first spacing is smaller than the second spacing.

* * * * *